US005767511A

United States Patent [19]

Macler

[11] Patent Number: 5,767,511

[45] Date of Patent: Jun. 16, 1998

[54] MEAN CLUSTER SIZE DETERMINATION USING WATER CAPTURE

[75] Inventor: Michel Macler, Lancaster, Calif.

[73] Assignee: Raytheon Company, Lexington, Mass.

[21] Appl. No.: 686,005

[22] Filed: Jul. 25, 1996

[51] Int. Cl.[6] ..... H01J 49/26

[52] U.S. Cl. ..... 250/281; 250/282

[58] Field of Search ..... 250/281, 282

[56] References Cited

U.S. PATENT DOCUMENTS

| | | | |
|---|---|---|---|
| 3,801,788 | 4/1974 | Milne | 250/282 |
| 4,559,096 | 12/1985 | Friedman et al. | 156/272.2 |
| 5,110,435 | 5/1992 | Haberland | 427/523 |

*Primary Examiner*—Jack I. Berman
*Attorney, Agent, or Firm*—W. C. Schubert; G. H. Lenzen, Jr.

[57] ABSTRACT

Clusters, such as Argon gas clusters, provided by a cluster source are doped in a water pick-up cell, and subsequent electron impact ionization of the doped clusters in a mass spectrometer or gas analyzer produce ionized cluster fragments that retain water. Water is supplied under pressure to the pick-up cell disposed within a vacuum chamber, and the water pressure is metered by a metering valve and monitored by a pressure gauge. A vacuum pump is coupled to the vacuum chamber that generates a vacuum within the vacuum chamber and pick-up cell. Interaction between the gas clusters and the water in the pick-up cell produces doped clusters, some of which retain water. The electron impact ionized doped cluster fragments are analyzed using the mass spectrometer or gas analyzer permits determination (detection) of the mean cluster size of the clusters. The variation in intensity of the water-containing fragments versus water pressure in the pick-up cell exhibits a Poisson behavior, from which the cross-section and mean cluster size is derived.

9 Claims, 3 Drawing Sheets

MEAN CLUSTER SIZE DETERMINATION USING WATER CAPTURE

This invention was made with Government support under Contract No. F04611-93-C-0005 awarded by The Department of the Air Force. The Government has certain rights in this invention.

BACKGROUND

The present invention relates generally to apparatus and methods for measuring mean cluster sizes of Van der Waals clusters, and more particularly, to an improved mean cluster size measuring apparatus and method that employs ionized water-containing fragments that are analyzed by a mass spectrometer or gas analyzer to determine the mean cluster size.

In the prior art, cluster sizes were predominantly determined using time of flight mass spectrometry. For accurate results, especially for small clusters, sophisticated Rice-Ramsperger-Kassel-Marcus (RRKM) calculations are performed in order to correct the observed cluster sizes. The instrumentation required to observe, calculate and correct the observed cluster sizes is costly, typically in excess of $60,000 at the present time.

Electron diffraction measurements allow determination of the structure of very small clusters, but electron diffraction equipment is expensive and the procedures are time consuming. Diffraction patterns must be generated and compared quantitatively with observed results. Consequently, the electron diffraction measurements are not obtained in a routine manner. Rayleigh scattering techniques require the use of a laser and associated optics. The laser must be calibrated and these techniques have fairly low sensitivity.

A number of articles have been published that generally relate to the present invention. These include an article by T. Gough, et al., in J. Chem. Phys. 83, 4958–4961 (1985), that discusses water doping. An article by M. Lewerenz et al., J. Chem. Phys. 102, 8191–8207 (1995) discloses that the intensity of water containing Helium cluster ion peaks versus water pressure follows a Poisson distribution. O. F. Hagena et al., in J. Chem. Phys. 56, 1793–1802 (1972) discusses scaling laws for both pressure and temperature variations. Mean cluster size data have been published by O. F. Hagena, Z. Phys. D: Atoms, Molecules, and Clusters 4, 292–299 (1987), Rev. Sci. Instrum. 63, 2374–2379 (1992, and by Farges et al. in J. Chem. Phys. 84, 3491–3501 (1986) who used electron diffraction. Corrected time of flight spectroscopy data is discussed by R. Karnbach, et al., in Rev. Sci. Instrum. 64, 2838–2849 (1993). Rayleigh scattering is discussed by A. J. Bell, et al. in J. Phys. D: Appl. Phys. 26, 994–996 (1993), and electron diffraction is discussed by E. T. Verkhovtseva, et al., in Chem. Phys. Lett. 140, 181–188 (1987) and by E. T. Verkhovtseva, et al., in Chem. Phys. Lett. 97, 483 (1983).

Accordingly, it is an objective of the present invention to provide for mean a cluster size measuring apparatus and method that employs ionized water-containing fragments that are analyzed to determine mean cluster size.

SUMMARY OF THE INVENTION

To meet the above and other objectives, the present invention processes clusters in a water pick-up cell to generate clusters doped with water, and subsequent electron impact ionization of the doped clusters to produce ionized cluster fragments that retain water. Water is supplied under pressure to a pick-up cell disposed within a vacuum chamber, and the water pressure is metered by a metering valve and monitored by a pressure gauge, such as by an ion gauge. A high speed vacuum pump is coupled to the vacuum chamber that generates a vacuum within the vacuum chamber and pick-up cell. A cluster source supplies a beam of clusters, such as Argon gas clusters, for example, that are sent through the pick-up cell along an axis thereof. Interaction between the gas clusters and the water in the pick-up cell produces doped clusters, some of which retain water. Analysis of the ionized cluster fragments using a mass spectrometer or rare gas analyzer permits determination (detection) of the mean cluster size of the clusters. The variation in intensity of the water-containing fragments versus water pressure in the pick-up cell display a Poisson behavior, from which the cross-section and mean cluster size of the clusters is derived. Using small fragment intensity variations to determine mean cluster size is novel.

By following the peak intensity of small ionized cluster fragments, one alleviates the need for a mass spectrometer with large mass range. In fact, an inexpensive, commercially available, rare gas analyzer may be used as a mass spectrometer when the masses of the fragments of interest are no higher than about 200 amu. The use of water makes the pick-up cell inexpensive and its operation is not toxic for an operator. The data analysis is simple and may be performed using a laptop computer and commercially available software, such as a Sigmaplot program available from Jandel Scientific, for example. The apparatus is compact, inexpensive, and portable. Furthermore, the operator does not need extensive training or skills.

Other conventionally used cluster size measurement techniques have involved time of flight mass spectrometry, Rayleigh scattering, and electron diffraction as outlined in the Background section. These techniques are expensive, sophisticated, time consuming, and require a skilled operator.

Any process that uses cluster deposition may benefit from the use of the present invention. Cluster size is a very important parameter for applications that require cluster deposition, which include the deposition of semiconductor thin films and microstructures, optical coatings, and superconductor thin films, and the like. Also, in the case of relatively large clusters, such as are used in photographic emulsions and nanoparticle production, the use of the present invention may provide benefits as well.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
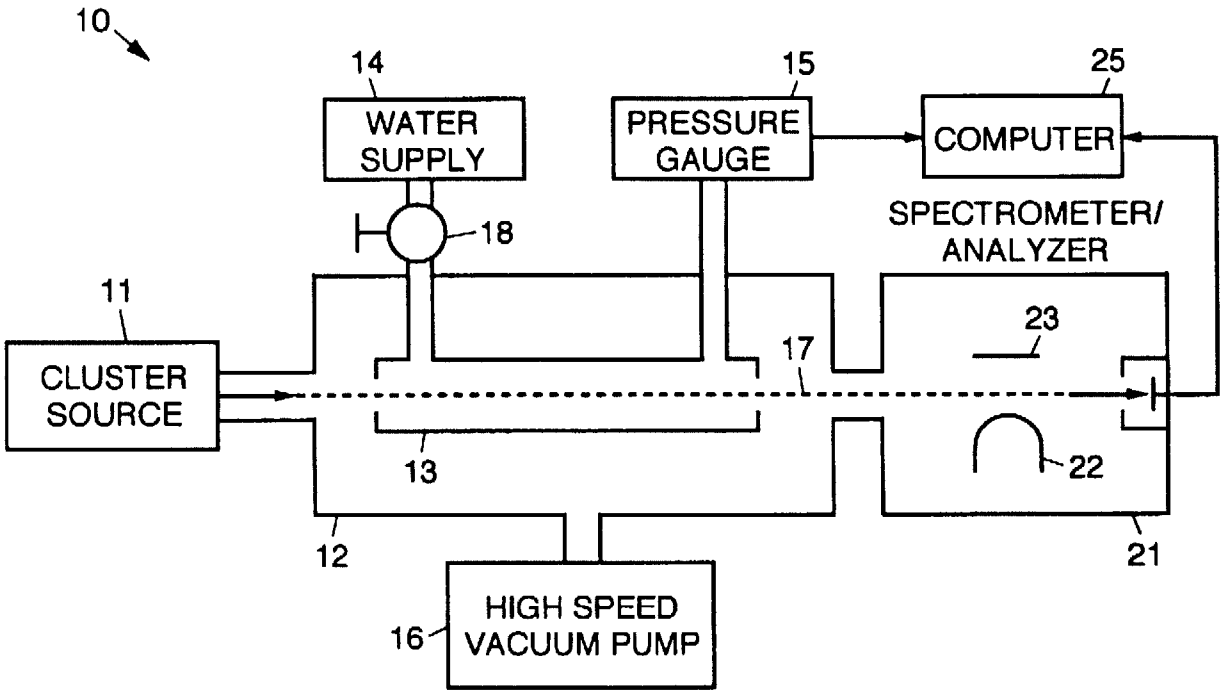
FIG. 1 illustrates apparatus in accordance with the principles of the present invention for determining the mean cluster size of clusters.

Referring to the drawing figures, FIG. 1 illustrates apparatus 10 in accordance with the principles of the present invention for determining the mean cluster size of clusters. The apparatus 10 comprises a cluster source 11 that generates a beam of clusters, such as Argon gas clusters, for example. A pick-up cell 13 is disposed within a vacuum chamber 12, and a water supply 14, a metering valve 18 and a pressure gauge 15, such as an ion gauge pressure gauge 15, are coupled to the pick-up cell 13 for supplying water thereto and measuring the pressure of the water within the pick-up cell.

A high speed vacuum pump 16 is coupled to the vacuum chamber 12 that generates a vacuum within the vacuum chamber 12 and pick-up cell 13. The cluster source 11 supplies the beam of clusters that are sent through the pick-up cell 13 along a central axis 17 thereof. Interaction between the gas clusters and the water in the pick-up cell 13 produces water doped clusters, some of which retain water.

The water doped clusters are directed at a gas analyzer 21 or a spectrometer 21 that includes an electron filament 22 and bias filament 23 that are used to ionize the clusters. The gas analyzer 21 is used to perform the functions of a spectrometer. The ionized cluster fragments are analyzed by the gas analyzer 21 to produce output signals indicative of ionized cluster fragments. The output signals from the gas analyzer 21 are coupled to a computer 25 along with pressure readings from the pressure gauge 15.

Analysis of the ionized cluster fragments using a software program, such as a Sigmaplot program available from Jandel Scientific, for example, running on the computer 25 permits determination (detection) of the mean cluster size of the clusters. The variation in intensity of the water-containing fragments versus water pressure in the pick-up cell 13 has a Poisson behavior, from which the cross-section and mean cluster size of the clusters is derived using the software running on the computer 25. Using small fragment intensity variations to determine mean cluster size is a novel aspect of the present invention.

The technique implemented by the present invention is quite simple. It may be performed using the water pick-up cell 13, rare gas analyzer 21 and computer 25. The present invention relies on the "stickiness" of water to clusters and on the fragmentation of ions generated by electron impact ionization of the clusters in the spectrometer/analyzer 21.

In operation, Argon clusters, for example, enter the vacuum chamber 12, which held down to about $10^{-6}$ Torr by the vacuum pump 16. On axis 17, the pick-up cell 13, in which water pressure is regulated by the metering valve 18 and measured by the ion gauge 15. The length of the pick-up cell 13 is on the order of 3–5 inches. The Argon cluster beam passes through the pick-up cell 13 where it is "doped" with water. The doped cluster beam then enters the gas analyzer 21, which may be a residual gas analyzer or a quadrupole mass spectrometer, for example. The doped cluster beam is then electron impact ionized in the analyzer 21, typically with 70 eV electrons, for example, generated by the electron and bias filaments 22, 23, before being analyzed by the residual gas analyzer 21 or quadrupole mass spectrometer 21.

The Argon clusters comprise Argon atom aggregates of variable sizes. The aggregates pick up water readily because water "sticks" to them. At that point, a certain fraction of them are doped with water, but they are still neutral. The ionization and fragmentation occurs upon electron impact ionization. This is general for all Van der Waals clusters, including rare gases, methane, nitrogen, oxygen, and metals such as sodium and lithium. Water sticks to the ionized fragments because it is strongly attracted to ions, i.e., the ionized cluster fragment will very likely contain water. Only the ionized cluster fragments are detected, so it is important that they contain water. The derived cluster size is not that of the ionized cluster fragments, but that of the parent clusters. The Poisson distribution is indicative of the initial cluster size. Therefore, what is measured is the parent mean cluster size, i.e., the number of atoms in the aggregates prior to doping.

The mass peak intensities corresponding to 4–10 cluster atoms/molecules plus one water molecule are measured for a range of water pressures, typically from 0 to 1 m Torr. These intensities follow a Poisson distribution given by: $I=K(\alpha L)\exp(-\alpha L)$. The parameter $\alpha$ is given by: $\alpha=n\sigma_{capture}F_{a0}(\infty, x)$ where K is a constant, n is the number density of water, L the length of the pick-up cell 13, and $F_{a0}(\infty, x)$ is a velocity averaging correction factor for an assumed velocity independent hard-sphere potential. The term x is given by: $x=c/v$, where $v$ is the thermal velocity of water molecules, and c is the cluster beam velocity. The F factor is a tabulated parameter.

The observed intensities are then fitted to such a distribution using a nonlinear least square fitting routine which is performed by the software program running on the computer 25. Such fitting routines yield cross sections $\sigma$. Assuming a unity sticking coefficient for water, and knowing the cluster mass density, the cluster size is determined.

The cluster size measurement method has been tested using argon (Ar) clusters. Argon clusters were produced by means of supersonic expansion using a sonic orifice having a diameter of 0.17 mm. The resulting beam was skimmed and differentially pumped twice. Both stagnation pressure and temperature were varied to obtain cluster sizes in the 30–500 atoms/cluster range. More specifically, stagnation pressures were varied in the 1.2–3.4 atm. range, while stagnation temperatures spanned the 100–300 K range. The ultimate chamber pressure was $10^{-7}$ Torr. These clusters were subsequently doped with water in the pick-up cell 13. The water pressure in the pick-up cell 13 was varied between 0 and $10^{-4}$ Torr. The doped clusters were electron impact ionized and detected using a triple quadrupole mass spectrometer 21. The dependence of $Ar_nH_2O^+$ fragment intensities on water pressure reflected Poisson distributions. Such dependency is expected for random phenomena with low probability.

More specifically, water doping occurred in a third pumping stage using a pick-up method discussed in an article by T. Gough, et al., in J. Chem. Phys. 83, 4958–4961 (1985), with a doping path of about 1 meter. The water pressure was increased progressively from 0 to $10^{-4}$ Torr, resulting in an increasing level of Argon cluster doping, up to the formation of water clusters alone. Clusters were ionized by 100 eV electrons. The ionized fragments were detected by a triple quadrupole mass spectrometer. The intensity of the water containing Argon cluster ion peaks versus water pressure followed a Poisson distribution, such as is discussed by M. Lewerenz et al., J. Chem. Phys. 102, 8191–8207 (1995). Analysis of this data yielded water capture cross-section for Argon clusters. Assuming the sticking coefficient of water on Argon to be unity, and the clusters to be spherical., these cross-sections were converted into mean cluster sizes.

Figure 2:
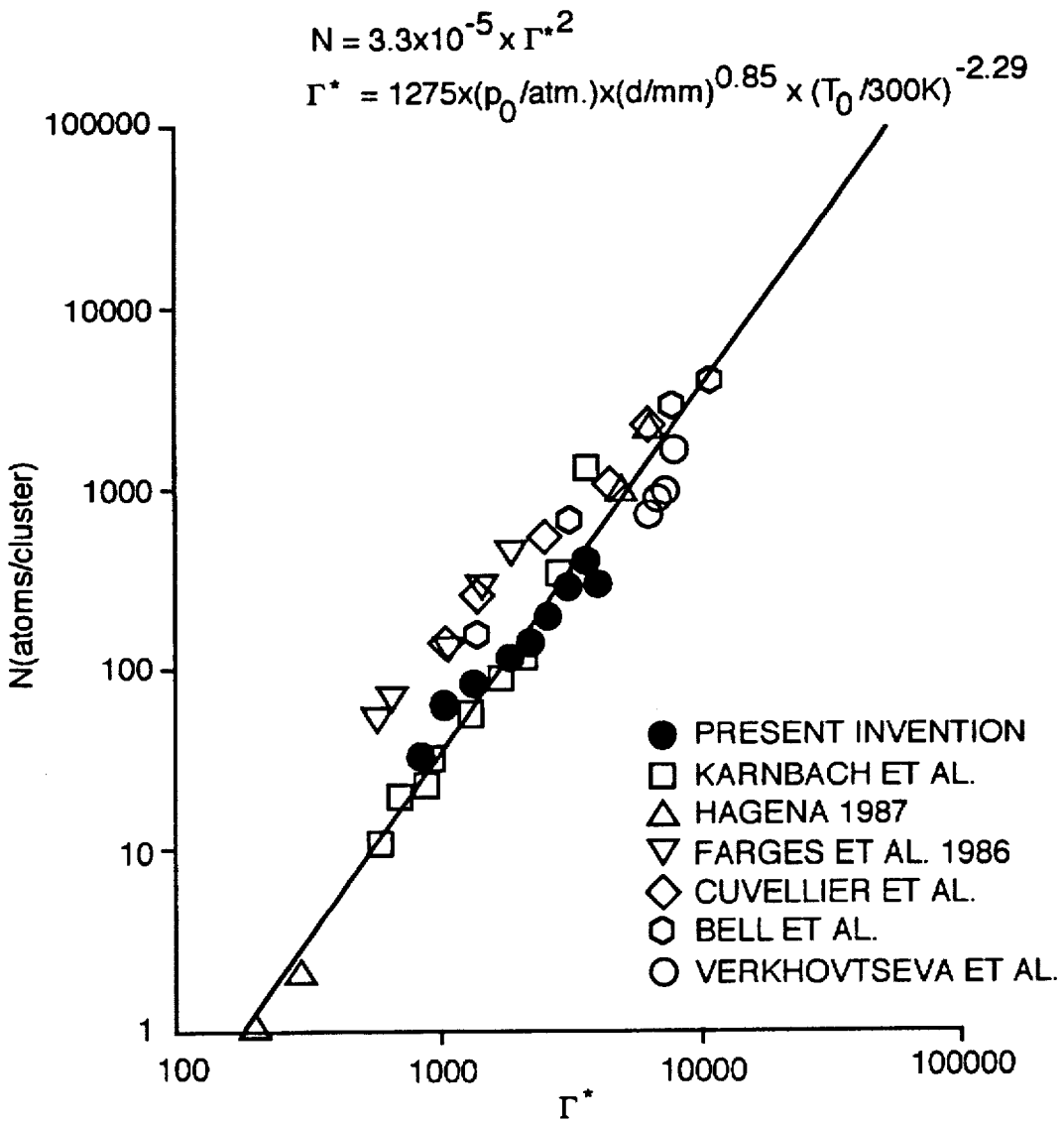
FIG. 2 is a graph comparing results of tests obtained using the present invention and other conventional approaches.

Scaling laws for both pressure and temperature variations were derived. They were in agreement with results published by O. F. Hagena et al., in J. Chem. Phys. 56, 1793–1802 (1972). To further verify the validity of the assumptions the mean cluster sizes were compared with those previously published, using a condensation parameter (F) as a scaling factor as disclosed in O. F. Hagena, Z. Phys. D: Atoms, Molecules, and Clusters 4, 292–299 (1987), Rev. Sci. Instrum. 63, 2374–2379 (1992). The graph of FIG. 2 shows this comparison. Except for the results of Farges et al. published in J. Chem. Phys. 84, 3491–3501 (1986), which show consistently higher cluster sizes than others, the results shown in FIG. 2 derived using the present invention are in good agreement with results derived from corrected time of flight spectroscopy discussed by R. Karnbach, et al., in Rev. Sci. Instrum. 64, 2838–2849 (1993), Rayleigh scattering data discussed by A. J. Bell, et al. in J. Phys. D: Appl. Phys. 26, 994–996 (1993), and electron diffraction data discussed by E. T. Verkhovtseva, et al., in Chem. Phys. Lett. 140, 181–188 (1987), and in Chem. Phys. Lett. 97, 483–487 (1983).

Water capture cross-section were determined from the Poisson distributions. Assuming the sticking coefficient of water to be unity, these cross-sections were converted to mean cluster sizes using bulk densities. The dependence of the mean cluster size on stagnation conditions was similar to those reported in a number of articles on the subject. As is customary, cluster sizes were correlated with a Hagena condensation parameter. Agreement with previously published data was very good. FIG. 2 shows a comparison between the cluster sizes obtained using the present invention and data obtained from previously published articles cited above. The equations shown in FIG. 2 directly correlates the condensation parameter and the actual cluster size.

Figure 3:
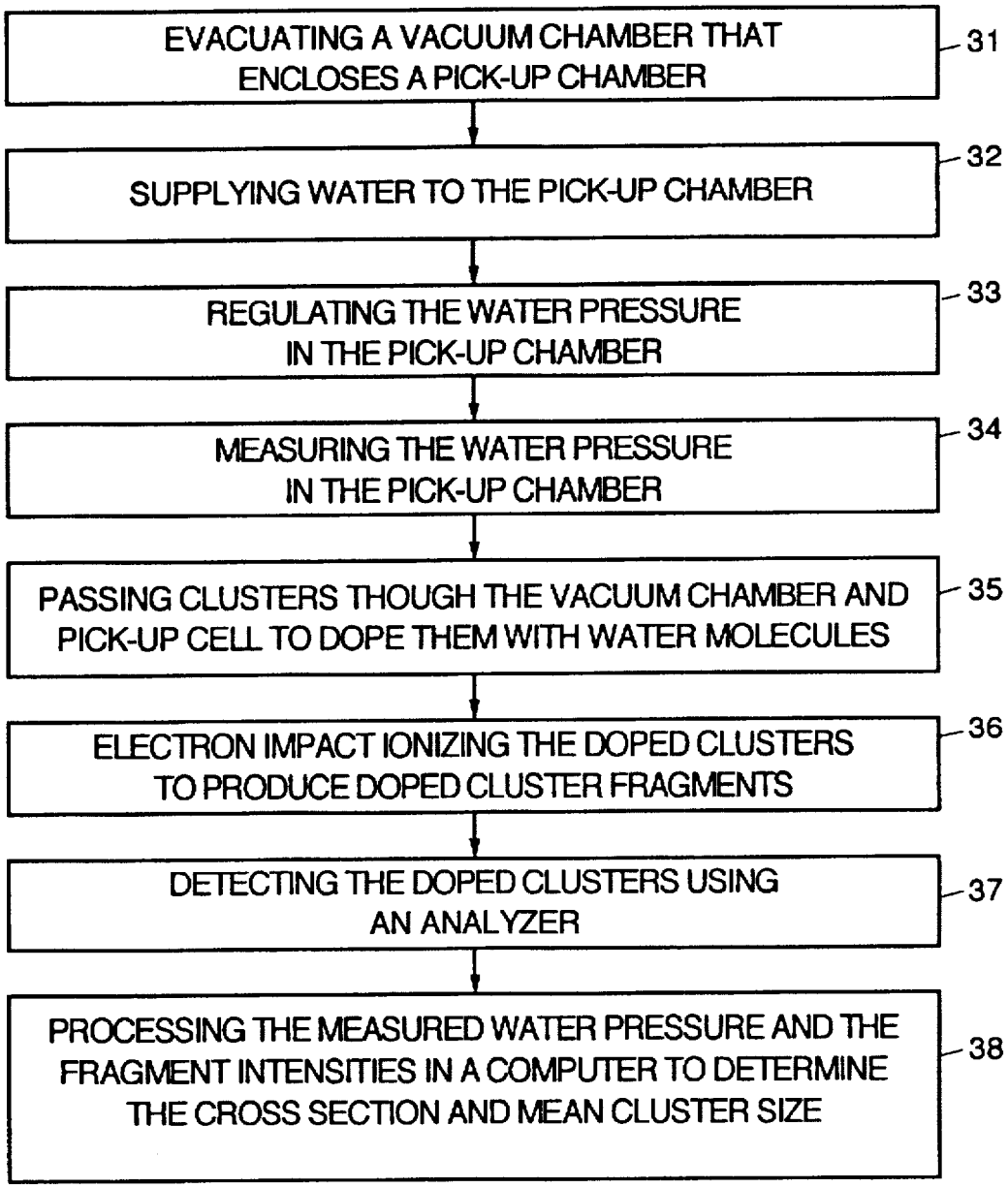
FIG. 3 is a flow chart of a method of determining the mean cluster size of clusters in accordance with the principles of the present invention.

For the purposes of completeness, FIG. 3 shows a flow chart illustrating a method 30 of determining mean cluster size of clusters in accordance with the principles of the present invention. The method 30 comprises the following steps.

A vacuum chamber 12 that houses a pick-up chamber 13 is evacuated 31 and water is supplied 32 to the pick-up chamber 13. The water pressure is regulated 33 by a metering valve 18 and measured 34 by an ion gauge 15. Clusters are made to traverse 35 through the vacuum chamber 12 and pick-up cell 13 where they are doped with water molecules. The doped clusters are electron impact ionized 36 to produce doped cluster fragments and then detected 37 using a triple quadrupole mass spectrometer 21 or residual gas analyzer 21, for example. The measured water pressure provided by the ion gauge 15 and the fragment intensities provided by the analyzer 21 are processed 38 in a computer 25 wherein the dependence of fragment intensities on water pressure is determined, and from which the cross-section and mean cluster size (Van der Waals mean cluster size) of the fragments are determined (calculated).

The water pick-up apparatus 10 and method 30 of the present invention provides a viable, inexpensive, and simple alternative to measuring mean cluster sizes in supersonic expansions. This is significant because traditional methods such as electron diffraction, time of flight mass spectrometry, cross-molecular beam scattering, etc., require expensive hardware, sophisticated analysis, and operator expertise.

Thus, an improved apparatus and method for measuring mean cluster sizes of Van der Waals clusters have been disclosed. It is to be understood that the described embodiment is merely illustrative of some of the many specific embodiments which represent applications of the principles of the present invention. Clearly, numerous and varied other arrangements may be readily devised by those skilled in the art without departing from the scope of the invention.

What is claimed is:

1. Apparatus for determining the mean cluster size of clusters, said apparatus comprising:

a vacuum chamber;

pick-up cell is disposed within a vacuum chamber;

a water supply coupled to the pick-up cell for supplying water thereto;

a pressure gauge coupled to the pick-up cell for measuring the pressure of the water within the pick-up cell and providing pressure reading as output signals therefrom;

a vacuum pump coupled to the vacuum chamber and pick-up cell that generates a vacuum therein;

a cluster source for generating a beam of clusters that are passed through the pick-up cell to produce clusters that retain water;

an analyzer for ionizing and fragmenting the clusters and for producing output signals indicative of intensities of the ionized cluster fragments; and a computer for processing the output signals from the analyzer and the pressure readings from the pressure gauge to determine the dependence of fragment intensities on water pressure, and determine the cross-section and mean cluster size of the clusters.

2. The apparatus of claim 1 wherein the cluster source is an Argon gas cluster source for generating a beam of Argon gas clusters.

3. The apparatus of claim 1 wherein the pressure gauge comprises an ion gauge pressure gauge.

4. The apparatus of claim 1 wherein the beam of clusters is passed through the pick-up cell along a central axis thereof.

5. The apparatus of claim 1 further comprising a metering valve coupled to the pick-up cell for regulating the pressure in the pick-up cell.

6. A method of determining the mean cluster size of clusters, said method comprising that steps of:

evacuating a vacuum chamber enclosing a pick-up chamber;

supplying water to the pick-up chamber;

measuring the water pressure in the pick-up chamber;

passing clusters through the vacuum chamber and pick-up cell to dope them with water molecules;

electron impact ionizing the doped clusters to produce doped cluster fragments;

detecting the electron impact ionized clusters using an analyzer; and processing the measured water pressure and the fragment intensities to determine the dependence of fragment intensities on water pressure, and calculate the cross-section and mean cluster size of the clusters.

7. The method of claim 6 wherein the step of detecting the electron impact ionized clusters comprises the step of detecting the clusters using a triple quadrupole mass spectrometer.

8. The method of claim 6 wherein the step of detecting the electron impact ionized clusters comprises the step of detecting the clusters using a residual gas analyzer.

9. The method of claim 6 further comprising the step of: regulating the water pressure in the pick-up chamber.

* * * * *